US005453136A

United States Patent [19]

Kim et al.

[11] Patent Number: 5,453,136

[45] Date of Patent: Sep. 26, 1995

[54] PROCESS FOR MANUFACTURING HIGH MAGNETIC FLUX DENSITY GRAIN ORIENTED ELECTRICAL STEEL SHEET HAVING SUPERIOR MAGNETIC PROPERTIES

[75] Inventors: Jong K. Kim; Sung J. Lee; Young J. Yoon, all of Phang, Rep. of Korea

[73] Assignee: Pohang Iron & Steel Co., Ltd., Kyong Sang Book-do, Rep. of Korea

[21] Appl. No.: 98,389

[22] Filed: Aug. 9, 1993

[30] Foreign Application Priority Data

Dec. 26, 1991 [KR] Rep. of Korea ..... 1991 24375

[51] Int. Cl.[6] ..... C22C 38/44

[52] U.S. Cl. ..... 148/111; 148/112

[58] Field of Search ..... 148/111, 112, 148/113, 307, 308; 420/118

[56] References Cited

U.S. PATENT DOCUMENTS

| | | | |
|---|---|---|---|
| 3,287,183 | 11/1966 | Taguchi et al. | 148/111 |
| 4,046,602 | 9/1977 | Stanley | 148/111 |
| 4,806,176 | 2/1989 | Harase et al. | 148/111 |

FOREIGN PATENT DOCUMENTS

| | | |
|---|---|---|
| 49-72118 | 7/1974 | Japan . |
| 56-4613 | 1/1981 | Japan . |
| 57-14737 | 3/1982 | Japan . |
| 59-185725 | 10/1984 | Japan . |
| 60-48886 | 10/1985 | Japan . |
| 61-104025 | 5/1986 | Japan . |
| 91-2917 | 5/1991 | Rep. of Korea . |

*Primary Examiner*—David A. Simmons
*Assistant Examiner*—Sikyin Ip
*Attorney, Agent, or Firm*—Webb Ziesenheim Bruening Logsdon Orkin & Hanson

[57] ABSTRACT

A process for manufacturing a high magnetic flux density grain oriented thin electrical steel sheet having superior magnetic properties and for use on transformers is disclosed. Proper amounts of Sn, Cr, Ni and Mo are added into a high magnetic flux density grain oriented electrical steel sheet in which AlN and MnS are utilized for inhibiting the growth of the primary recrystallization grains. The process results in the production of a high magnetic flux density grain oriented thin electrical steel sheet showing a stabilized recrystallization, a high productivity and a high yield.

7 Claims, No Drawings

PROCESS FOR MANUFACTURING HIGH MAGNETIC FLUX DENSITY GRAIN ORIENTED ELECTRICAL STEEL SHEET HAVING SUPERIOR MAGNETIC PROPERTIES

FIELD OF THE INVENTION

The present invention relates to a process for manufacturing a high magnetic flux density grain oriented electrical steel sheet having superior magnetic properties and for use as iron cores of transformers and the like.

BACKGROUND OF THE INVENTION

Generally, a grain oriented electrical steel is used as iron cores for transformers and other electrical devices. For their magnetic characteristics, it is desirable to have a high magnetic induction and a low iron loss along the cold rolling direction. To have these characteristics, a grain oriented electrical steel has to be manufactured with cube-on-edge (110)[001] texture.

Such a (110)[001] texture is obtained through a secondary recrystallization, and this secondary recrystallization is a form of abnormal grain growth. That is, of the fine crystal grains produced through the normal recrystallization, grains of a particular orientation, i.e., grains with the (110)[001] orientation grow abnormally on the whole, thereby forming a secondary recrystallization. The driving force of secondary recrystallization is determined by the grain boundary energy and the size difference between the would-be secondary grain and fine primary grains. Therefore, if the growth of the secondary recrystallization grains of the orientation of (110)[001] is to be promoted, it is necessary to inhibit the growth of the primary recrystallization grains, and, in doing this, the method of adding precipitates such as MnS, AlN, BN and the like is used.

There have been proposed various techniques for manufacturing high magnetic flux density grain oriented electrical steel sheets, and one of these is U.S. Pat. No. 3,287,183. According to the method of this patent, silicon is added in the amount of 3%, and AlN and MnS are also added for inhibiting the growth of the primary recrystallization grains. Further, the final cold rolling reduction ratio is increased up to 81–95%, thereby increasing the magnetic flux density.

As a method of reducing the iron loss of the oriented high flux density electrical steel sheet, it has been proposed that the contents of silicon be increased, and the thickness of the sheet be decreased. However, if the silicon contents are increased, and the thickness of the sheet is decreased, then the secondary recrystallization becomes unstable, and the magnetic properties are deteriorated. Therefore, there is required a method of stabilizing the secondary recrystallization. As methods for stabilizing the secondary recrystallization under a high silicon content and a reduced sheet thickness, there have been proposed various techniques, and one of them is Japanese Patent Publication No. Sho-60-48886 which proposes to add Sn and Cu. According to this method, Sn is added in a range of 0.05–1.0% in order to stabilize the secondary recrystallization, and Cu is added in order to improve the deterioration of the glass film, which is caused by the addition of Sn.

The additions of Sn and Cu are effective for stabilizing the secondary recrystallization and for increasing the magnetic flux density. However, the additions of Sn and Cu markedly increases cracks on the surface of the hot rolled sheet coil, and these surface cracks cause fractures of sheets during cold rolling, thereby decreasing the productivity and yield.

Korean Patent Publication No. 91-2917 proposes a method in which 2 to 4 elements having low dissolvability to steel are added. That is, 2 to 4 elements selected from among Sn, Cu, Sb, Cr, Ni, Pb, Mo and Nb are added in amounts such that their ratio to the total weight of AlN+MnS should come within the range of 1–5. The patent asserts that, when such an addition is made, the growth of the fine precipitates of AlN and MnS is inhibited, thereby stabilizing the secondary recrystallization. However, in this method also, if the addition of Sn and Cu exceeds a certain level, cracks are formed during hot rolling, with the result that the actual yield is decreased.

Japanese Patent Laying Opening No. Sho-49-72118 presents a method of adding Cu in order to stabilize the secondary recrystallization. According to this method, Cu thus added forms $Cu_2S$ by reacting with S existing within the steel, and this reinforces the inhibition of the grain growth in cooperation with the already existing inhibitors, thereby stabilizing the secondary recrystallization. However, according to the investigations of the present inventors, the addition of Cu gives no significant effect to stabilizing the secondary recrystallization, but rather gives adverse effects such as formation of surface cracks during hot rolling, and generation of decarburization defects.

Japanese Patent Publication Nos. Sho-57-14737 and Sho-56-4613 propose a method of adding Mo to oriented electrical steel sheet. The addition of Mo is done in order to prevent hot rolling cracks caused by S during hot rolling. This is considerably effective in preventing the surface cracks during hot rolling, but it can cause insufficient decarburization, if Mo is singularly added.

SUMMARY OF THE INVENTION

Therefore it is the object of the present invention to provide a process for manufacturing a high magnetic flux density grain oriented thin electrical steel sheet having superior magnetic properties. In accordance with the present invention, AlN and MnS are added in order to inhibit the growth of the primary recrystallization grains as usual, and then, Sn, Cr, Ni and Mo are added in proper amounts, thereby stabilizing the secondary recrystallization, and improving the productivity and yield.

DESCRIPTION OF THE PREFERRED EMBODIMENT

The present invention will be described in detail below.

The electrical steel of the present invention contains in weight %: 0.01–0.1% of C, 2.5–4.0% of Si, 0.04–0.15% of Mn, 0.005–0.04% of P, 0.005–0.04% of S, 0.01–0.05% of Al, 0.002–0.01% of N, and small amounts of Cu, Sn, Cr and Mo as inhibitor stabilizing agents. First, this steel is cast into slabs by continuous casting or ingot casting, and then, the slabs are hot-rolled to a gage of 2.3 mm. Then the steel is cold-rolled to a final gage of 0.30 or 0.2 mm, the final reduction ratio of the cold rolling process being over 80%. Further, inhibitor stabilizing elements Sn, Cr, Ni and Mo are added in the amounts of: 0.01–0.04% of Sn, 0.02–0.12% of Cr, 0.02– 0.12% of Ni, and 0.01–0.08% of Mo. Further, it is observed that the total amount of the four elements should come within the range of 0.06–0.20%, and, in this way, the high magnetic flux density grain oriented electrical steel sheet having superior magnetic properties is manufactured.

Now the reason for providing the limiting ranges for the composition of ingredients will be described.

Regarding Si, if its addition is less than 2.5%, the iron loss is aggravated, and, if its addition exceeds 4.0%, the steel becomes brittle, thereby making it to be impossible to subject the steel to cold rolling. Accordingly, its addition should desirably come within the range of 2.5–4.0%, and should more desirably come within the range of 2.8–3.8%.

Regarding C, it forms a proper hot rolling structure, and provides a high strain energy for cold rolling. Therefore its addition should be 0.01% at minimum. If its addition exceeds 0.1%, problem occurs during the decarburization, as well as degrading the magnetic properties. Therefore, its addition should desirably come within the range of 0.01–0.10%.

Mn which prevents the formation of hot rolling cracks and inhibits the growth of the primary recrystallization grains is needed in an amount of over 0.04%, but, if it is added in an amount of over 0.15%, it becomes difficult to dissolve completely into a solid solution in the reheating furnace during hot rolling. Therefore its addition range should desirably be limited to 0.04–0.15%, and more desirably to 0.05–0.12%.

The lower limit of P in the usual steel making process is 0.005%, and, if its amount is over 0.04%, it becomes difficult to carry out cold rolling. Accordingly, its addition range should desirably be 0.005–0.04%.

S which forms MnS for inhibiting the growth of the primary recrystallization grains is needed in an amount of 0.005%, but, if its addition amount exceeds 0.04%, it becomes difficult to desulpherize in the final annealing process, thereby aggravating iron loss. Accordingly, S should desirably be added in a range of 0.005–0.04%, and more desirably in a range of 0.015–0.04%.

Al is added so as for it to form AlN for inhibiting the growth of the primary recrystallization grains, and it is needed in an amount of 0.01% at minimum. If its content is over 0.05%, the precipitation of AlN becomes excessive, while its performance as the inhibitor for the growth of the primary recrystallization grains is rather weakened. Accordingly, its addition range should desirably be 0.01–0.05%.

The addition range of N should desirably be 0.002–0.01% in consideration of the content of AlN.

The elements Sn, Cr, Ni and Mo have a relatively low solubility in steel, and, if these elements are added, they are segregated around the precipitates, so that the fine precipitates used as the inhibitors for the growth of the primary recrystallization grains should be protected, and that the secondary recrystallization should be stabilized. This effect is reinforced as more kinds of elements among Sn, Cr, Ni and Mo are added, because the more complicated protecting films are formed around the precipitates. Therefore, adding these elements together give stronger effects compared with the case of adding a single element.

If Sn is added in an amount of less than 0.01%, no significant effect for stabilizing the secondary recrystallization is obtained, while, if its addition exceeds 0.04%, the cold rollability is deteriorated, as well as causing insufficient decarburization. Accordingly, its addition should desirably be limited to a range of 0.01–0.04%.

If Cr is added in an amount of less than 0 02%, it gives no significant effect, while, if it is added in an amount of over 0.12%, insufficient decarburization can be resulted. Accordingly, its addition should desirably be limited to a range of 0.02–0.12%.

If Ni is added in an amount of less than 0.02%, no effect is obtained, while, if it is added in an amount of over 0.12%, the effect is not increased at all. Accordingly, the desirable addition range for it is 0.02–0.12%.

Mo shows the effect of preventing cracks hot rolling, and its proper addition range is 0.01–0.08%.

When the elements Sn, Cr, Ni and Mo are added, Mo and Ni give effects to the precipitates of MnS series, while Cr and Sn assist in the precipitation of AlN. Consequently, both of the AlN and MnS precipitates are stabilized.

However, if the addition of the Sn, Cr, Ni and Mo is excessive, there will occur cracks during hot rolling, fractures and insufficient decarburization. Therefore the total amount of Sn, Cr, Ni and Mo should desirably be limited to a range of 0.06–0.20%, in consideration of the fact that the inhibitors which prevent the growth of the primary recrystallization grains should be stabilized, and that brittleness, surface defects and insufficient decarburizations should be prevented.

The steel prepared in the above described manner is formed into slabs by letting the steel undergo a continuous casting or an ingot casting. Then the slabs are subjected to hot rolling, and the hot rolled sheets are reduced to the final gage by cold rolling. Then a decarburizing annealing is carried out, and then, an annealing separator containing MgO as the major ingredient is spread. Then a final annealing is carried out at a temperature of 1200° C., then a hot rolling flattening process is carried out, and then, an insulating film is spread, thereby completing the manufacturing of a high magnetic flux density grain oriented thin electrical steel sheet having superior magnetic properties and having a thickness of 0.23–0.30 mm.

Now specific actual examples will be described below.

EXAMPLE 1

A heat of steel containing 3.25% of Si, 0.07% of Mn, 0.075% of C, 0.026% of acid soluble Al, 0.025% of S, 0.008% of N and a small amount of Cu, Sn, Cr, Ni and Mo was melted. Cu, Sn, Cr, Ni and Mo were added as shown in Table 1 below. Then the steel was cast into slabs by continuous casting, hot-rolled to a gage of 3.3 mm, annealed at a temperature of 1125° C., and then, cold-rolled to a gage of 0.30 mm. Then the usual grain oriented silicon steel manufacturing process was carried out including a decarburizing annealing.

The steels were subjected to tests as to magnetic properties, the depth of hot rolling cracks, the rate of the cold rolling fractures and the actual yield.

The results are shown in Table 1 below.

TABLE 1

| | Third elmnts (wt %) | | | | | | Magnetic prpts | | Productivity | | |
|---|---|---|---|---|---|---|---|---|---|---|---|
| Heat | Cu | Sn | Cr | Ni | Mo | Totl | B10(T) | W17/50 (W/kg) | Cracks of hot rllg mm | Fract % | Yld % |
| Com 1 | 0.1 | 0.1 | — | — | — | 0.2 | 1.92 | 0.98 | 36.5 | 45.2 | 46.6 |
| Com 2 | 0.15 | — | — | — | — | 0.15 | 1.84 | 1.37 | 28.0 | 36.9 | 12.1 |
| Com 3 | — | 0.01 | 0.01 | 0.01 | 0.01 | 0.04 | 1.86 | 1.31 | 5.0 | 9.1 | 34.5 |
| Invt 1 | — | 0.01 | 0.02 | 0.02 | 0.01 | 0.06 | 1.90 | 1.07 | 4.5 | 7.5 | 81.0 |
| Invt 2 | — | 0.04 | 0.04 | 0.04 | 0.03 | 0.15 | 1.93 | 0.96 | 4.5 | 7.3 | 85.7 |
| Invt 3 | — | 0.04 | 0.05 | 0.05 | 0.06 | 0.20 | 1.94 | 0.97 | 5.4 | 9.6 | 83.1 |
| Com 4 | — | 0.04 | 0.08 | 0.08 | 0.05 | 0.25 | 1.93 | 0.97 | 31 | 32.8 | 46.8 |

In the above table, "Com" indicates comparative heats, while "invt" indicates the heats of the present invention. Further, "Cracks of hot rllg" indicates the average depth of cracks formed during hot rolling, and "fract" indicates the percentage of fractures occurred during cold rolling, i.e., fractures/number of coils×100, while "Yld" indicates the real yield of products acceptable in shape and magnetic properties.

As shown in Table 1 above, in the case of Comparative Heat 1 where Cu and Sn were added, its magnetic properties were superior, but cracks formed during hot rolling and fractures formed during cold rolling were severe, and was inferior in the yield, thereby making it unsuitable for mass production. Meanwhile, Comparative Test Piece 2 in which only Cu was added showed that both its magnetic properties and the productivity were all inferior.

In the case of Comparative Heat 3 in which Sn, Cr, Ni and Mo were added too little, the magnetic properties and the productivity were deteriorated, while Comparative Heat 4, in which Sn, Cr, Ni and Mo were added too much, showed that the magnetic properties were superior, but that the productivity was deteriorated.

On the other hand, the Heats 1 to 3 of the present invention, in which Sn, Cr, Ni and Mo were added in such a manner as to come within the composition range of the present invention, were not only superior in their magnetic properties, but also showed superior characteristics in the hot rolling cracks, in the cold rolling fractures and in the yield, thereby proving them to be suitable as industrial products.

EXAMPLE 2

A melted steel was formed by adding: 3.27% of Si, 0.065% of Mn, 0.070% of C, 0.027% of Al, 0.023% of S, and 0.007% of N, and small amounts of Sn, Cr, Ni and Mo. This steel was diversified into 6 different ones, by adding no third elements in one of them, and by varying the addition of Sn, Cr, Ni and Mo in the rest of them. These steels were cast into slabs by continuous casting, then hot rolled to a gage of 2.3 mm, and then, reduced to a thickness of 0.23 mm by cold rolling. Then the usual manufacturing processes were carried out including a decarburizing annealing. Then inspections were carried out on the relationship of the magnetic properties, the hot rolling cracks, and the cold rolling fractures and the yield to the variations of the addition of Sn, Cr, Ni and Mo, the result thus obtained being shown in Table 2 below.

TABLE 2

| | Third elements (wt %) | | | | | Magnetic prpts | | Productivity | | |
|---|---|---|---|---|---|---|---|---|---|---|
| Heat | Sn | Cr | Ni | Mo | Totl | B10(T) | W17/50 (W/kg) | Cracks of hot rllg mm | Frac-tures % | Yld % |
| Com 1 | — | — | — | — | 0.00 | 1.81 | 1.36 | 3.5 | 5.5 | 3.6 |
| Com 2 | 0.00 | 0.08 | 0.03 | 0.02 | 0.13 | 1.85 | 1.36 | 5.5 | 4.1 | 36.5 |
| Com 3 | 0.03 | 0.00 | 0.05 | 0.05 | 0.13 | 1.85 | 1.16 | 8.3 | 6.0 | 41.4 |
| Com 4 | 0.03 | 0.02 | 0.00 | 0.08 | 0.13 | 1.84 | 1.26 | 5.2 | 6.7 | 25.3 |
| Com 5 | 0.02 | 0.06 | 0.05 | 0.00 | 0.13 | 1.86 | 1.07 | 15.8 | 38.4 | 45.6 |
| Com 6 | 0.07 | 0.02 | 0.02 | 0.02 | 0.13 | 1.92 | 0.92 | 53.6 | 72.4 | 54.2 |
| Invt 1 | 0.02 | 0.04 | 0.04 | 0.03 | 0.13 | 1.91 | 0.90 | 4.8 | 5.0 | 82.5 |
| Invt 2 | 0.03 | 0.02 | 0.05 | 0.03 | 0.13 | 1.93 | 0.89 | 4.5 | 5.1 | 85.4 |

As shown in the Table 2 above, Comparative Heat 1, in which Sn, Cr, Ni and Mo were not added at all, showed that hot rolling cracks were rarely found and the cold rollability was superior, but the magnetic properties were extremely bad, as well as the yield being less than 10%. Meanwhile, in the case where Sn, Cr, Ni and Mo were added, although the total content of Sn, Cr, Ni and Mo was 0.13% for all the heats, if any one of Sn, Cr, Ni and Mo was omitted as in the cases of Comparative Heats 2 to 5, the magnetic properties and the yields were extremely aggravated. Further, in the case where the addition of Sn was departed from the proposed range of the present invention as in Comparative Heat 6, the magnetic properties were good, but the hot rolling crack and the cold rollability were aggravated, as well as unacceptable in the yield.

On the other hand, Heats 1 and 2 of the present invention, in which the composition range of the present invention was applied, showed that their magnetic properties and the productivity were superior.

According to the present invention as described above, proper amounts of third elements Sn, Cr, Ni and Mo are added into a high magnetic flux density grain oriented electrical steel in which AlN and MnS are utilized for inhibiting the growth of the primary recrystallization grains. The result is that there is provided a process for manufacturing a high magnetic flux density grain oriented thin electrical steel sheet having superior magnetic properties and a high productivity, and having a thickness range of 0.23–0.30 mm. Thus the process of the present invention is suitable for industrial mass productions.

What is claimed is:

1. A process for manufacturing a high magnetic flux density grain oriented electrical steel having superior magnetic properties on the order of greater than about 1.9 Tesla magnetic flux density (B10) and less than about 1.07 W/Kg iron or core loss (W17/50), comprising the steps of:

preparing melted steel consisting essentially of, in weight %: 0.01–0.10% of C, 2.5–4.0% of Si, 0.04–0.15% of Mn, 0.005–0.04% of P, 0.005–0.04% of S, 0.01–0.05% of Al, 0.002–0.010% of N, 0.01–0.04% of Sn, 0.02–0.12% of Cr, 0.02–0.12% of Ni, 0.01–0.08% of Mo, the balance being Fe plus incidental impurities;

controlling the total weight % of Sn+Cr+Ni+Mo between 0.06–0.20%;

forming said steel into slabs by a continuous casting process;

hot rolling said slabs; and cold rolling to reduce the previously hot rolled slab by over 80% down to a thickness of 0.30–0.23 mm, whereby said process yields high productivity defined by an average crack depth of less than about 5.4 mm formed during said hot rolling step and a fracture frequency % of less than about 9.6% occurring during said cold rolling step, wherein the fracture frequency % is calculated by a number of fractures divided by a number of coils produced multiplied by 100.

2. The process for manufacturing a high magnetic flux density grain oriented electrical steel as claimed in claim 1, wherein the Si content is between 2.8–3.8%.

3. The process for manufacturing a high magnetic flux density grain oriented electrical steel as claimed in claim 1, wherein the Mn and S contents are between 0.05–0.12% and 0.015–0.04% respectively.

4. A process for manufacturing a high magnetic flux density grain oriented electrical steel having superior magnetic properties on the order of greater than about 1.9 Tesla magnetic flux density (B10) and less than about 1.07 W/Kg iron or core loss (W17/50), comprising the steps of:

providing a steel composition consisting essentially of, in weight %: 0.01–0.10% of C, 2.5–4.0% of Si, 0.04–0.15% of Mn, 0.005–0.04% of P, 0.005–0.04% of S, 0.01–0.05% of Al, 0.002–0.010% of N, 0.01–0.04% of Sn, 0.02–0.12% of Cr, 0.02–0.12% of Ni, 0.01–0.08% of Mo, the balance being essentially Fe;

wherein the total weight % of said Sn, Cr, Ni and Mo is 0.06–0.20%;

casting said steel;

hot rolling said cast steel into a sheet; and cold rolling said sheet to reduce a thickness of said sheet by over 80% to an approximate thickness of 0.30–0.23 mm, whereby said process yields high productivity defined by an average crack depth of less than about 5.4 mm formed during said hot rolling step and a fracture frequency % of less than about 9.6% occurring during said cold rolling step, wherein the fracture frequency % is calculated by a number of fractures divided by a number of coils produced multiplied by 100.

5. The process of claim 4 wherein said Si content is 2.8–3.8%.

6. The process of claim 4 wherein said Mn content is 0.05–0.12%.

7. The process of claim 4 wherein said S content is 0.015–0.04%.

* * * * *

UNITED STATES PATENT AND TRADEMARK OFFICE

CERTIFICATE OF CORRECTION

PATENT NO. : 5,453,136
DATED : September 26, 1995
INVENTOR(S) : Jong K. Kim, Sung J. Lee and Young J. Yoon It is certified that error appears in the above-indentified patent and that said Letters Patent is hereby corrected as shown below:

Title page, in section '[75] Inventors:', "Phang" should read --Pohang--.

Column 1 Line 65 "additions" should read --addition--.

Column 4 Line 11 after "cracks" insert --during--.

Claim 3 Line 8 Column 8 after "0.015-0.04%" insert --,--.

Signed and Sealed this

Thirtieth Day of January, 1996

*Attest:*

Bruce Lehman

BRUCE LEHMAN

*Attesting Officer*

*Commissioner of Patents and Trademarks*